US006752385B2

(12) United States Patent
Zen et al.

(10) Patent No.: US 6,752,385 B2
(45) Date of Patent: Jun. 22, 2004

(54) RAILING SYSTEM

(76) Inventors: Paul Robert Zen, 1655 Smith Avenue, Coquitlam, British Columbia (CA), V3J 2Y4; Sergio Luigi Zen, 3851 Chelsea Court, Burnaby, British Columbia (CA), V5A 3H9

( * ) Notice: Subject to any disclaimer, the term of this patent is extended or adjusted under 35 U.S.C. 154(b) by 0 days.

(21) Appl. No.: 10/074,867

(22) Filed: Feb. 12, 2002

(65) Prior Publication Data

US 2003/0151039 A1 Aug. 14, 2003

(51) Int. Cl.[7] ..... E04H 17/00

(52) U.S. Cl. ..... 256/65.01; 256/22; 256/65.15; 256/65.16; 256/59

(58) Field of Search ..... 256/21, 22, 26, 256/59, 60, 65.01–65.05, 65.15, 65.16, 67–69; 411/508–510, 913

(56) References Cited

U.S. PATENT DOCUMENTS

| | | | | | |
|---|---|---|---|---|---|
| 3,033,532 | A | * | 5/1962 | McFall | 256/21 |
| 3,258,251 | A | * | 6/1966 | Culter | 256/22 |
| 3,385,567 | A | * | 5/1968 | Case et al. | 256/24 |
| 3,414,236 | A | * | 12/1968 | Siegal | 256/22 |
| 3,506,243 | A | * | 4/1970 | Seiler | 256/59 |
| 3,689,032 | A | * | 9/1972 | Von Wedel et al. | 256/22 |
| 3,707,276 | A | * | 12/1972 | Francis et al. | 256/22 |
| 3,756,115 | A | * | 9/1973 | Schuplin | 411/508 |
| 3,955,799 | A | * | 5/1976 | Lauzier | 256/21 |
| 4,125,249 | A | | 11/1978 | Zen | 256/67 |
| 4,208,038 | A | * | 6/1980 | Reid | 256/67 |
| 4,667,935 | A | * | 5/1987 | Moore | 256/22 |
| 4,968,005 | A | | 11/1990 | Zen | 256/22 |
| 5,200,240 | A | | 4/1993 | Baker | 428/34.1 |
| D335,353 | S | | 5/1993 | Baker | D25/38 |
| 5,649,688 | A | * | 7/1997 | Baker | 256/21 |
| 6,029,954 | A | * | 2/2000 | Murdaca | 256/59 |

FOREIGN PATENT DOCUMENTS

| | | | | |
|---|---|---|---|---|
| JP | 5-202648 | * | 1/1992 | 256/65.15 |

* cited by examiner

*Primary Examiner*—Robert J. Sandy
*Assistant Examiner*—Ruth C. Rodriguez
(74) *Attorney, Agent, or Firm*—Christie, Parker & Hale, LLP

(57) ABSTRACT

A railing system comprising a first longitudinal rail portion defining a channel into which pickets are insertable at spaced intervals. Fasteners are used to pivotally connect the pickets to the channel for orientation to a desired angle with respect to the first longitudinal rail portion. A second longitudinal rail portion is fittable onto the first longitudinal rail portion to form an assembled rail member in which the channel and fasteners are concealed within the interior of the assembled rail member. The railing system provides a simple and efficient way to install railings, and is particularly suited for assembly of railings at an incline to the horizontal.

18 Claims, 5 Drawing Sheets

RAILING SYSTEM

FIELD OF THE INVENTION

This invention relates to railing system useful to form a barrier, fencing or the like. In particular, the invention relates to a railing system in which the pickets are readily adjustable to an angle with respect to the railing to allow forming of a barrier on a horizontal or on an inclined surface.

BACKGROUND OF THE INVENTION

Fencing and balustrades formed using a top railing supported by pickets or upstanding posts are commonly used on stairs, balconies and patios as a safety barrier with a pleasing appearance. They may be formed of materials such as wrought iron, vinyl, wood or aluminum. Aluminum is generally the preferred material. Aluminum is easy to extrude and form and is lightweight yet sturdy and enjoys excellent weather resistance.

The fencing or balustrade is typically formed as a railing system that includes a top railing secured to pickets that extend vertically downwardly from the top rail and which are spaced at desired intervals. The pickets may extend into a wooden or concrete base or the like, or, more usually are also attached to a bottom rail which, in turn, is mounted to the stairs or balcony for which the railing system acts as a barrier.

Examples of prior art railing systems include U.S. Pat. No. 4,968,005 to Zen and U.S. Pat. No. 5,200,240 to Baker.

In the installation of railing systems, particularly when the top railing is installed at an incline to the horizontal on stairs or sloped surfaces, for example, the problem of attaching the pickets to the top and bottom rails can result in considerable delay and in wastage of material. The conventional method of joining the pickets to the top and bottom rails is by welding. When the railings are inclined to the horizontal, it is necessary to measure the required angle and cut the ends of the pickets to the correct angle and length. If errors are made in transferring the measurements to the pickets then substantial waste can result. U.S. Pat. No. 4,125,249 to Zen discloses one solution to this problem by providing a railing structure having pivotable joints to mount the pickets to the railings for rotation to a desired angle to minimize wastage and maximize speed of construction.

SUMMARY OF THE INVENTION

The present invention provides a railing system and railing member that also allows pivoting of the pickets with respect to the railing to simplify installation. The arrangement of the present invention conceals the pivoting attachment of the pickets to the railings to provide an aesthetically pleasing appearance.

Accordingly, the present invention provides a railing system comprising:

- a first longitudinal rail portion defining a channel into which pickets are insertable at spaced intervals;
- fasteners to pivotally connect the pickets to the channel for orientation to a desired angle with respect to the first longitudinal rail portion; and
- a second longitudinal rail portion fittable onto the first longitudinal rail portion to form an assembled rail member with the channel and fasteners concealed within the interior of the assembled rail member.

The present invention also provides a railing system comprising a first longitudinal rail portion to pivotally support a plurality of pickets at spaced intervals for orientation to a desired angle and a second longitudinal rail portion fittable onto the first longitudinal rail portion to form an assembled rail member with the first longitudinal rail portion concealed by the second longitudinal rail portion.

In a further aspect, the present invention provides a rail member comprising:

- a first longitudinal rail portion defining a channel into which pickets are insertable at spaced intervals to be pivotally supported for orientation to a desired angle with respect to the first longitudinal rail portion; and
- a second longitudinal rail portion fittable onto the first longitudinal rail portion to form an assembled rail member with the channel concealed within the interior of the assembled rail member.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
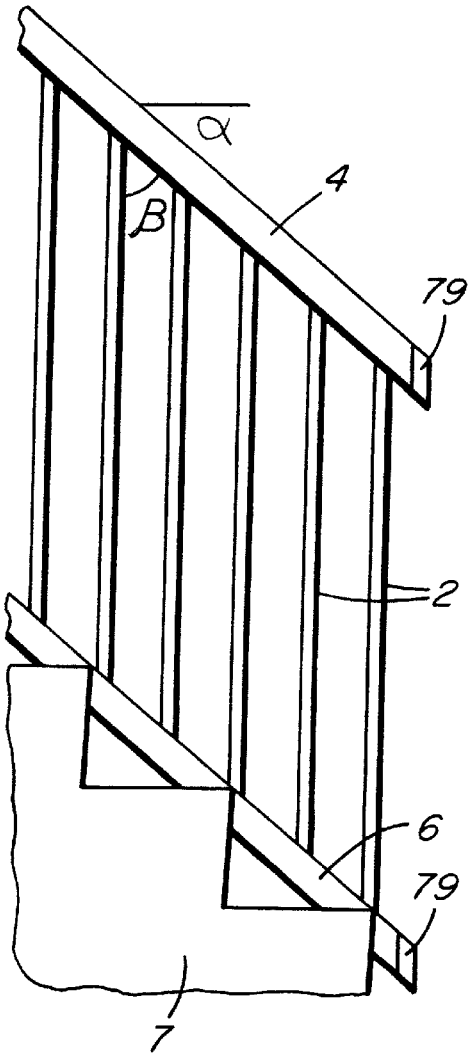
FIG. 1 is an elevation of an inclined railing system according to the present invention.

FIG. 1 shows a set of railings that employ the rail members and the railing system of the present invention. The railing system includes a top rail member 4 and a bottom rail member 6 each attached to a plurality of pickets 2. Rail members 4 and 6 are inclined at an angle to the horizontal to follow the rise of stairs 7. As will be described in more detail below, the railing system of the present invention permits pivotal adjustment of the pickets with respect to the rail members to accommodate a wide range of slopes of inclined surfaces such that the pickets remain essentially vertical while attached rail members are supported substantially parallel to the inclined surface.

Figure 2:
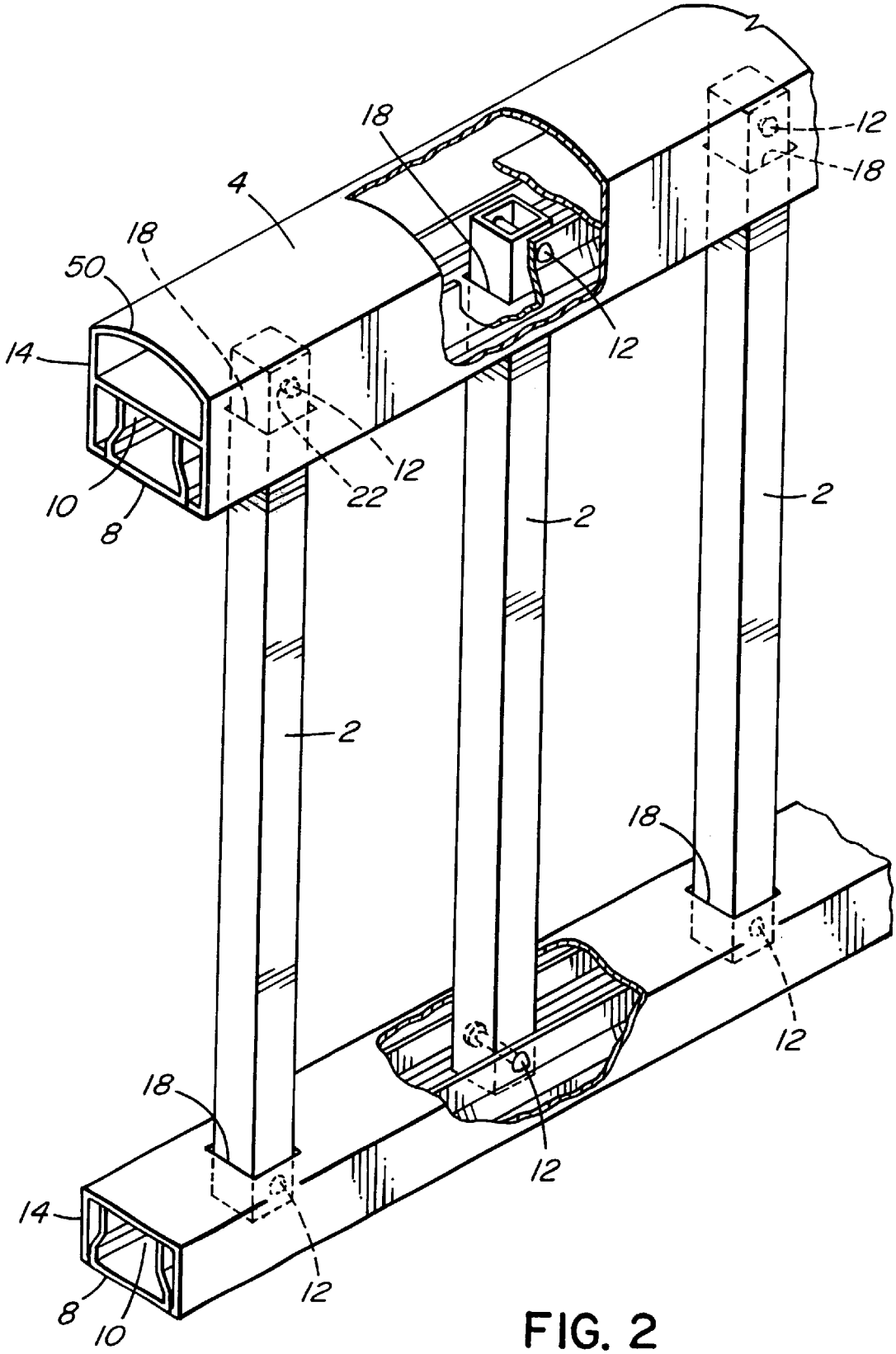
FIG. 2 is a detailed perspective view of the railing system of FIG. 1 configured in a substantially horizontal orientation of the railings.

It will be appreciated that the railing system of the present invention is also configurable for installation on a horizontal surface with the pickets extending at generally right angles to the rail members as shown in FIG. 2. Top rail member 4 and bottom rail member 6 are of similar construction and include a first longitudinal rail portion 8 which defines a channel 10 into which the ends of a plurality of pickets 2 are insertable at spaced intervals. Fasteners 12 are used to pivotally connect pickets 2 in channel 10 for orientation to a desired angle with respect to the first longitudinal rail portion. A second longitudinal rail portion 14 is fittable onto first longitudinal rail portion 8 to form the assembled rail member 4 or 6 with the channel 10 and fasteners 12 concealed within the interior of the assembled rail member.

Figure 3:
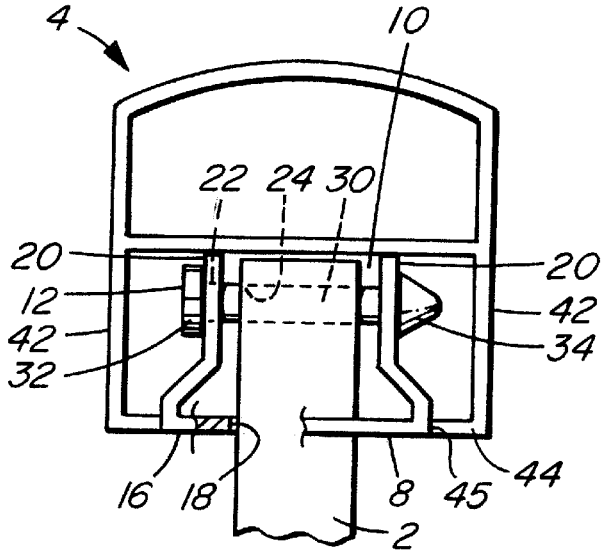
FIG. 3 is a section view through a rail member according to the present invention which is the top railing member of FIG. 2.

Referring to FIGS. 2 and 3, there is shown a perspective and cross-sectional view of top assembled rail member 4. First longitudinal rail portion 8 includes a lower surface 16 formed with a plurality of spaced openings 18 to receive the top end of picket 2 for insertion into channel 10. In the case of a first longitudinal rail portion formed of aluminum, each opening 18 is preferably formed by punching an appropriately shaped hole through lower surface 16. Each opening 18 is dimensioned to accommodate the pickets for pivoting over a range of angles to the first longitudinal rail portion 8. In the illustrated example of FIG. 3, pickets 2 are formed with a hollow, generally rectangular cross-section and openings 18 are elongated in the longitudinal direction of the rail portion to allow pivoting of the pickets without the picket walls interfering with the edges of the openings. It will be apparent to a person skilled in the art that pickets 2 can be formed with any regular cross-sectional shape as long as openings 18 in lower surface 16 are appropriately shaped and dimensioned. Generally, in most applications, rail members 4 and 6 are oriented in the range of 0 to about 38 degrees to the horizontal (angle $\alpha$ in FIG. 1) which requires that openings 8 be dimensioned to permit pivoting of pickets 2 in a range between about 90 degrees and about 52 degrees with respect to the longitudinal axis of the first longitudinal rail portion 8 (angle $\beta$ in FIG. 1).

First longitudinal rail member 8 is formed with a pair of spaced, upstanding side walls 20 that extend upwardly from the lower surface 16 to define channel 10 therebetween with an open top. Preferably, side walls 20 initially extend inwardly toward each other and upwardly at an angle to the lower surface and then extend upwardly in a spaced, parallel configuration.

In order to pivotally connect pickets 2 between side walls 20, aligned pairs of openings 22 are formed in the parallel portions of the side walls to accept fasteners 12. As best shown in FIG. 3, openings 22 are alignable with corresponding openings 24 formed in the side walls of pickets 2. The various sets of openings 22, 24 co-operate to receive a fastener 12 which is insertable through channel side walls 20 and the picket side walls to pivotally mount the pickets between the channel side walls.

Figure 3A:
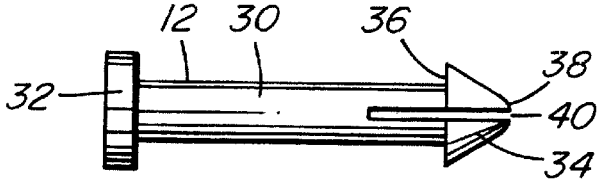
FIG. 3*a* is a detail view of a preferred fastener used with the railing system.

FIG. 3*a* is a detail view of a preferred fastener 12 for securing of the pickets within channel 10. The fastener is preferably formed from metal or plastic and comprises a rigid post 30 insertable through openings 22. Post 30 has an enlarged head 32 at one end to engage with the exterior of one channel side wall and a deformable locking body 34 at the opposite end to engage with the exterior of the other channel side wall. Deformable locking body 34 comprises a tapered member that extends from a wide shoulder 36 to a narrow tip 38 with a slot 40 extending from the tip to the shoulder. Slot 40 permits constriction and one-way insertion of the tapered member through the aligned openings 22 and 24 and subsequent expansion such that shoulder 36 abuts against the channel side wall 20. When installed in place within openings 22 and extending through picket 2, rigid post is anchored between the side walls 20 to pivotally support picket 2.

Referring back to FIG. 3, note that the initially inward angle of side walls 20 defines a recessed region on either side of side walls 20 into which head 32 and deformable locking body 34 protrude without interfering with the installation and mounting of second longitudinal rail portion 14 over first longitudinal rail portion 8.

Preferably, first and second longitudinal rail portions 8 and 14 are press fittable together. In the embodiment of FIG. 3, second rail portion 14 includes depending side walls 42 with lower inwardly directed flanges 44 that are snap fitted into a longitudinal groove 45 in the side walls 20 of first longitudinal rail portion 8. Side walls 42 cover and conceal first longitudinal rail portion 8, the protruding ends of fasteners 12 and the pivotally secured ends of pickets 2 in channel 10. Side walls 42 of the second longitudinal rail portion are joined by a top wall 46 that rests on the top edges of side walls 20 of the first longitudinal rail portion 8 to fully support the second longitudinal rail portion. As shown in FIG. 3, when used in a top rail member 4, second longitudinal rail portion can be formed with a rounded surface 50 over top wall 46 to provide a comfortable gripping surface.

Figure 4:
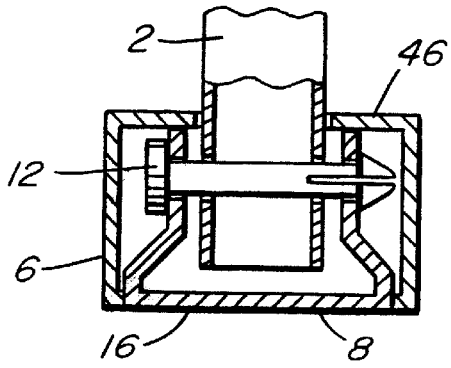
FIG. 4 is a section view through the bottom railing member of FIG. 2.

FIG. 4 is a section view through bottom rail member 6 which has substantially the same structure as the top rail structure of FIG. 3. The second longitudinal rail portion 14 is preferably a closer fit over first longitudinal rail portion 8 in the bottom rail member 6. Rounded surface 50 is not formed in the second longitudinal rail portion 14. It is the top wall 46 of the second longitudinal rail portion that is formed with openings 18 to receive the lower ends of pickets 2. Openings 18 are dimensioned to accommodate pivoting of the pickets over a range of angles to the second longitudinal rail portion and the lower ends of the pickets are supported by fasteners 12 to extend upwardly through the open top of channel 10 formed in first longitudinal rail portion 8.

Figure 5:
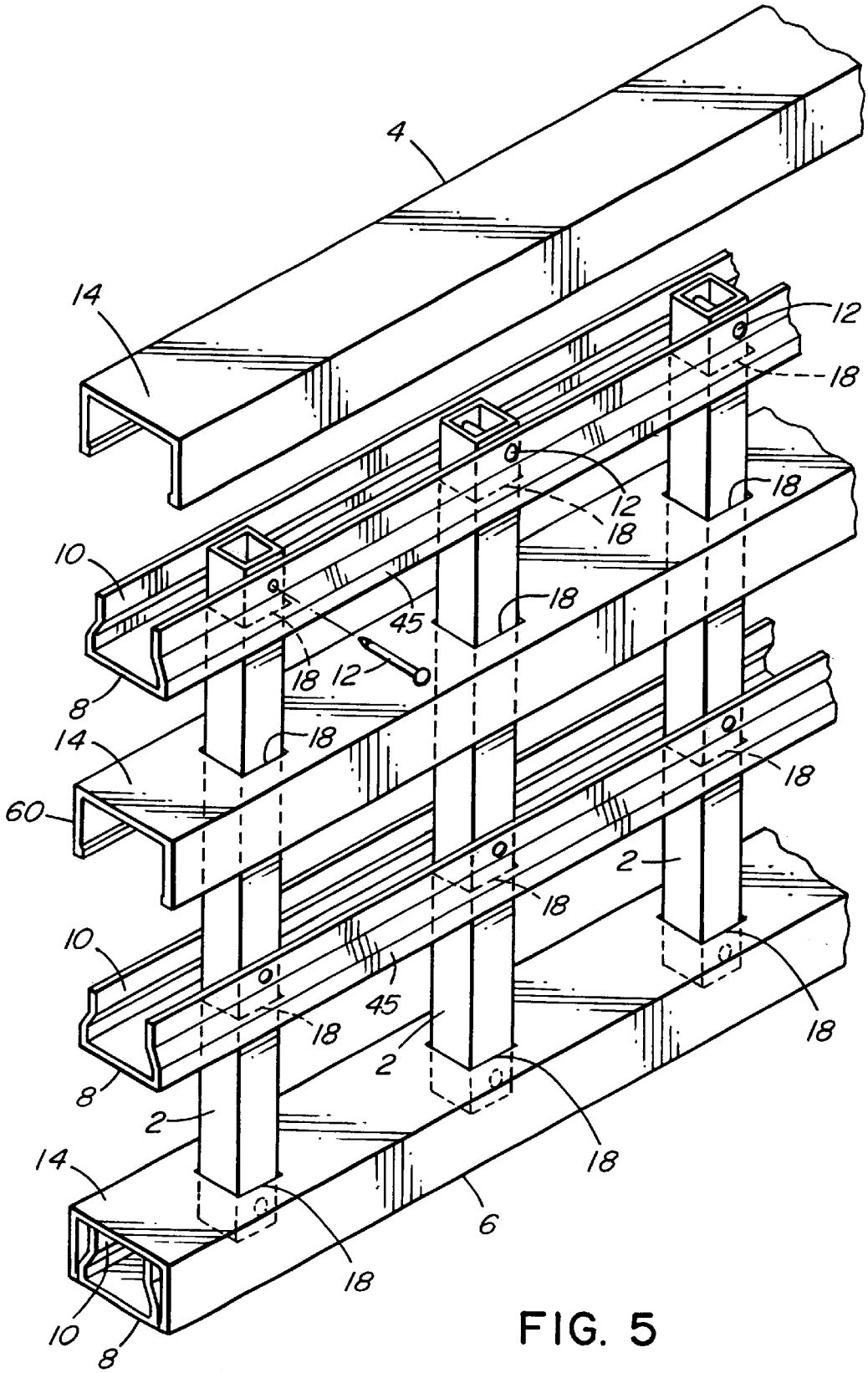
FIG. 5 is a partially exploded perspective view of another embodiment of the present invention having at least one intermediate railing member between the top and bottom railing members.

FIG. 5 is an exploded view of an alternative arrangement of the railing system of the present invention. The illustrated railing system includes an intermediate rail member 60 between top and bottom rail members 4 and 6, respectively. It will be apparent that multiple intermediate rail members can be installed depending on the length of pickets 2. All assembled rail members have the same basic structure as described above with a first longitudinal rail portions 8 having a channel 10 to pivotally support pickets 2 via fasteners 12 and a second longitudinal rail portion 14 that fits over the first rail member 8. In the case of intermediate rail members 60, both the first and second longitudinal rail portions 8 and 14 have aligned openings 18 to accommodate passage of the pickets through the assembled intermediate rail member.

Referring to FIG. 1, a cap member 79 is preferably attachable to the end of an assembled rail member to seal the interior of the rail member. Cap member 79 preferably comprises a sleeve fittable over the assembled rail member.

The first and second longitudinal rail portions that are fitted together to form an assembled rail member according to the present invention are preferably formed from extruded aluminum. The rail portions can be formed of other materials such as plastic. Pickets 2 are preferably also formed from aluminum so that the entire railing system provides a light weight, but sturdy arrangement that is weather resistant.

Figure 8:
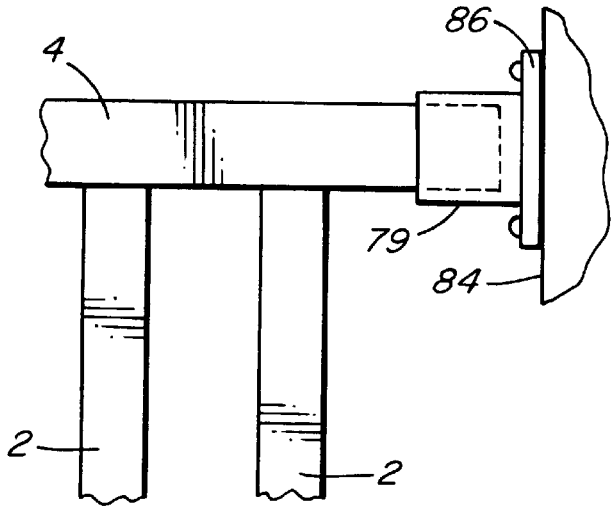
FIG. 8 is a detail view of a mounting member for connecting the railing system of the present invention to an essentially vertical bracing surface.

Sets of railings assembled according to the system of the present invention are maintained in the desired configuration by supporting the railing sets using conventional anchoring posts or other support or bracing surfaces such as walls, columns, building faces etc. Generally, the ends of the rail members are fastened to a bracing surface. For example, as illustrated in FIG. 8, the end of top rail member 4 is fastened to a vertical wall surface 84. Cap member 79 can include a mounting surface 86 for mounting the cap member to a vertical support surface 84 such as a wall.

Figure 6:
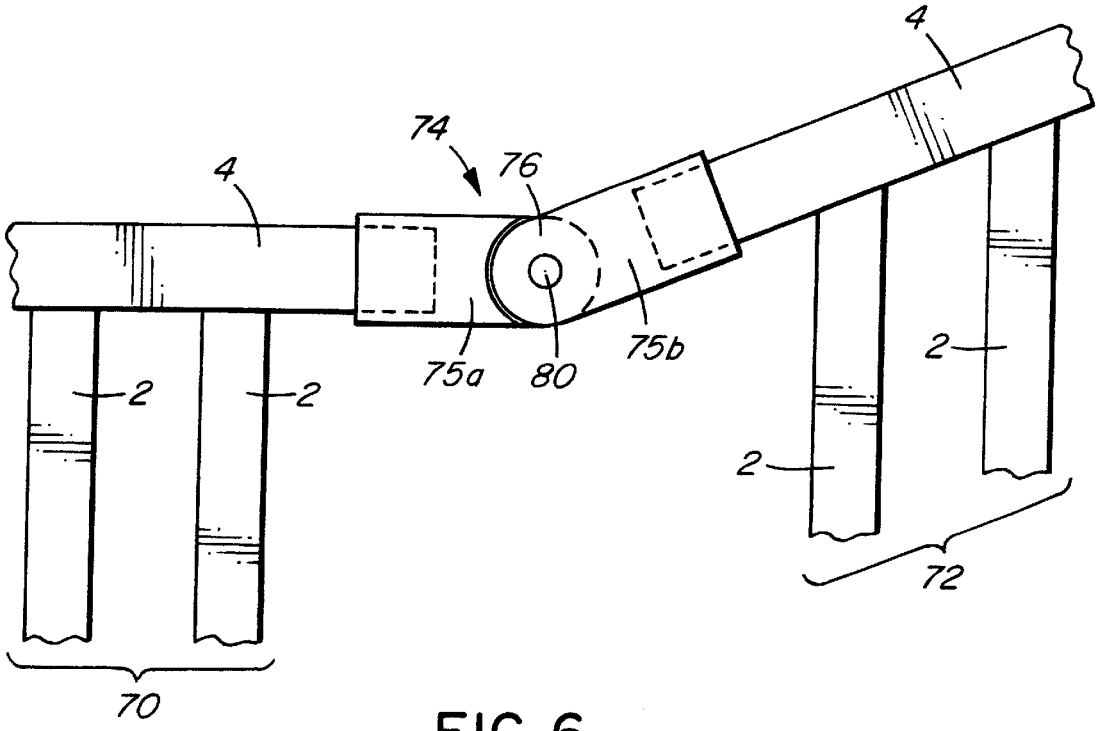
FIG. 6 is a detail view of a connection member used with the railing system of the present invention.
Figure 7:
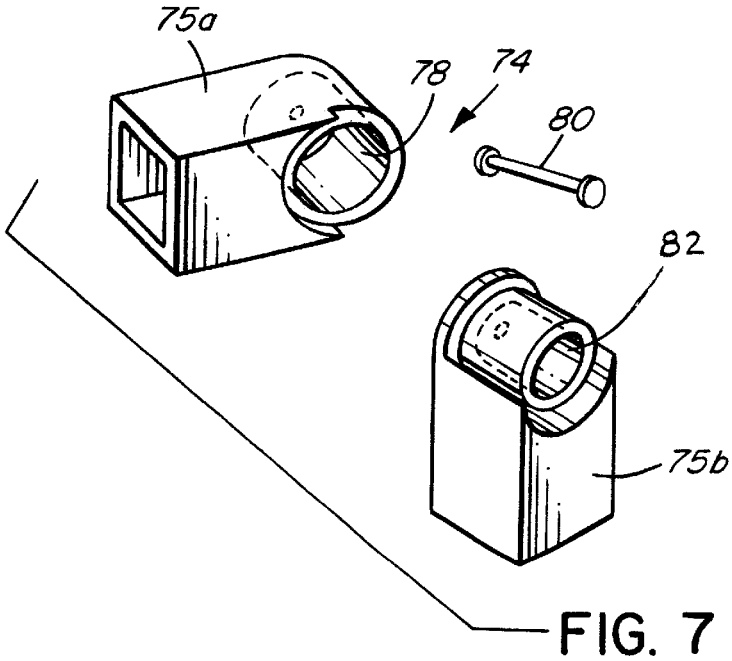
FIG. 7 is a disassembled view of the connection member of FIG. 6.
Figure 9:
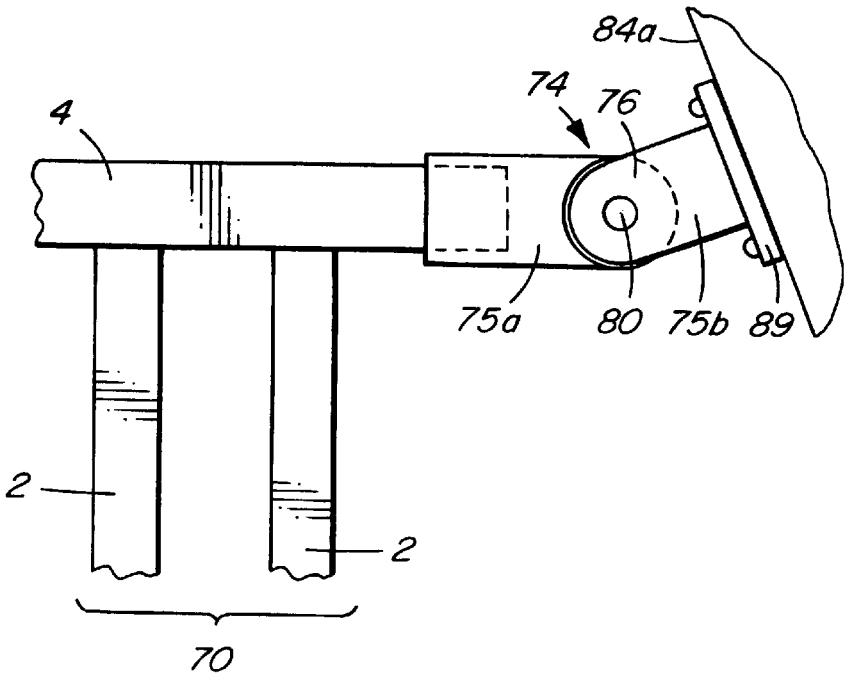
FIG. 9 is a detail view of a connection member for mounting the railing system to a vertical or non-vertical surface.

FIGS. 6, 7 and 9 illustrate various preferred arrangements for connecting one set of railings constructed according to the present invention to a support surface or a second set of railings. FIG. 6 shows a first set of railings 70 configured with an essentially horizontal assembled top railing member 4 and a second set of railings 72 configured with an angled assembled top railing member. A connection member 74 is fitted over the ends of the top rail member 4 to join the first and second sets of railings. Connection member 74 includes two sleeves 75*a* and 75*b* adapted to fit over the adjacent ends of the railing members. In order to accommodate the change in angle between the horizontal and inclined top railings members, sleeves 75*a* and 75*b* are connected by pivoting joint 76. FIG. 7 shows a preferred disassembled construction of joint 76. A circular housing 78 is formed in sleeve 75*a* to rotatably receive an annular flange 82 formed on sleeve 75*b*. The walls of sleeve 75*b* are cut away in an arcuate configuration about annular flange 82 to permit the insertion of the flange into the housing and mating of the sleeves for pivoting with respect to each other in the same vertical plane. A fastener 80 extends along the pivoting axis of the joint and engages against the outer faces of the sleeves to maintain the housing and sleeve in rotatable engagement.

In a modified form shown in FIG. 9, connection member 74 can be used to connect a set of railings 70 to a vertical or non-vertical support surface 84*a*. In this case, sleeve 75*a* is provided to fit over the top rail member 4 of a railing set and sleeve 75*b* is modified to include end plate 89 that is mountable to a non-vertical surface 84*a* instead of being fittable over the rail member of an adjacent set of railings. Joint 76 allows for end plate 89 to be mounted to a support surface 84 oriented at substantially any angle including a conventional vertical surface.

Although the present invention has been described in some detail by way of example for purposes of clarity and understanding, it will be apparent that certain changes and modifications may be practised within the scope of the appended claims.

We claim:

1. A railing system comprising:

a first longitudinal rail portion defining a channel into which pickets are insertable at spaced intervals, the channel being formed by a first longitudinal surface and a pair of spaced side walls extending inwardly toward each other adjacent the longitudinal surface as angled side wall portions, and then extending away from the first longitudinal surface as inset, planar side wall portions in a spaced, parallel configuration;

fasteners to pivotally connect the pickets to the channel insertable through pairs of openings in the inset planar side wall portions and through each picket to allow for orientation of each picket to a desired angle with respect to the first longitudinal rail portion, each of said fasteners comprising a rigid post having an enlarged head at one end to engage with an exterior of one of the planar side wall portions and a deformable locking body at an opposite end to engage with an exterior of the other of the planar side wall portions such that the rigid post is anchored between the side walls to pivotally support the picket; and a second longitudinal rail portion having a second longitudinal surface and side walls fittable over the first longitudinal rail portion such that the side walls of the second longitudinal rail portion engage the first longitudinal rail portion to form an assembled rail member with the channel and fasteners concealed within the interior of the assembled rail member and the enlarged head and locking body of each fastener being accommodated in the region between the side walls of the second longitudinal rail portion and the inset side wall portions of the first longitudinal rail portion.

2. A railing system as claimed in claim 1 in which first longitudinal surface of the first longitudinal rail portion includes a plurality of spaced openings to receive the pickets, the openings being dimensioned to accommodate the pickets over a range of angles to the first longitudinal rail portion.

3. A railing system as claimed in claim 1 in which the deformable locking body comprises a tapered member that extends from a wide shoulder to a narrow tip with a slot extending from the tip to the shoulder, the slot permitting constriction and one-way insertion of the body through the opening and subsequent expansion such that the shoulder abuts against the side wall.

4. A railing system as claimed in claim 1 in which the first and second longitudinal rail portions include aligned openings to accommodate passage of the pickets through the assembled rail member.

5. A railing system as claimed in claim 1 including top and bottom assembled rail members each attached to a plurality of pickets.

6. A railing system as claimed in claim 1 in which the second longitudinal rail portion includes openings to receive the pickets, the openings being dimensioned to accommodate the pickets over a range of angles to the second longitudinal rail portion, and the first longitudinal rail portion receives the pickets in the channel.

7. A railing system as claimed in claim 1 in which the first and second longitudinal rail portions are formed from extruded aluminum.

8. A railing system as claimed in claim 1 made of aluminum.

9. A railing system as claimed in claim 1 in which the first and second longitudinal rail portions are press fittable together.

10. A railing system as claimed in claim 1 including a cap member attachable to an end of the assembled rail member.

11. A railing system as claimed in claim 10 in which the cap member comprises a sleeve fittable over the assembled rail member.

12. A railing system as claimed in claim 11 in which the sleeve includes a mounting surface for mounting to a support surface.

13. A railing system as claimed in claim 1 including a connection member to join one assembled rail member to an adjacent assembled rail member.

14. A railing system as claimed in claim 13 in which the connection member comprises:

a first sleeve fittable over the one assembled rail member;

a second sleeve fittable over the adjacent assembled rail member; and a pivoting joint interconnecting the first and second sleeves.

15. A railing system for mounting a plurality of pickets to a rail at a desired angle comprising:

a first longitudinal rail portion having a longitudinal surface and a pair of spaced, upstanding side walls extending inwardly and upwardly toward each other over the longitudinal surface as angled side wall portions, and then extending upwardly as inset planar side wall portions in a spaced, parallel configuration over the longitudinal surface, the side walls defining a channel into which the pickets are insertable at spaced intervals, the longitudinal surface having a plurality of spaced openings to receive the pickets with the openings being dimensioned to accommodate the pickets over a range of angles to the first longitudinal rail portion;

fasteners-insertable through the inset side wall portions and the pickets to pivotally connect the pickets within the channel for orientation to a desired angle with respect to the first longitudinal rail portion, each of said fasteners comprising a rigid post having an enlarged head at one end to engage with an exterior of one of the side walls and a deformable locking body at an opposite end to engage with an exterior wall of the other side wall such that the rigid post is anchored between the side walls to pivotally support the picket; and a second longitudinal rail portion having an upper surface and downwardly depending side walls fittable over the first longitudinal rail portion such that the first longitudinal rail portion and the downwardly depending side walls of the second longitudinal rail portion engage adjacent the lower surface of the first rail longitudinal rail portion to form an assembled rail member with the channel and fasteners concealed within the interior of the assembled rail member and the enlarged head and locking body of each fastener being accommodated in the region between the side walls of the second longitudinal rail portion and the inset side wall portions of the first longitudinal rail portion.

16. A railing system as claimed in claim 15 in which the first and second longitudinal rail portions are formed from extruded aluminum.

17. A railing system as claimed in claim 15 made of aluminum.

18. A railing system as claimed in claim 15 in which the first and second longitudinal rail portions are press fittable together.

* * * * *